US007736139B2

(12) United States Patent
Sørby

(10) Patent No.: US 7,736,139 B2
(45) Date of Patent: Jun. 15, 2010

(54) MOTOR DRIVEN BY PRESSURE MEDIUM SUPPLIED FROM AN EXTERNAL PRESSURE SOURCE

(76) Inventor: Reidar Sørby, Lønborglien 284, Bergen (NO) N-5039

( * ) Notice: Subject to any disclaimer, the term of this patent is extended or adjusted under 35 U.S.C. 154(b) by 463 days.

(21) Appl. No.: 11/572,708

(22) PCT Filed: Jul. 28, 2005

(86) PCT No.: PCT/NO2005/000280

§ 371 (c)(1),
(2), (4) Date: Feb. 22, 2007

(87) PCT Pub. No.: WO2006/011808

PCT Pub. Date: Feb. 2, 2006

(65) Prior Publication Data

US 2008/0310985 A1 Dec. 18, 2008

(30) Foreign Application Priority Data

Jul. 28, 2004 (NO) ..... 20043203

(51) Int. Cl.
*F04C 2/00* (2006.01)
*F04C 18/00* (2006.01)

(52) U.S. Cl. ..... 418/268; 418/183; 418/188; 418/259

(58) Field of Classification Search ..... 418/259, 418/266–268, 183, 185–186
See application file for complete search history.

(56) References Cited

U.S. PATENT DOCUMENTS

| | | | | |
|---|---|---|---|---|
| 3,871,337 | A | 3/1975 | Green | |
| 4,415,322 | A * | 11/1983 | Baudin | 418/260 |
| 4,451,215 | A * | 5/1984 | Winkler et al. | 418/260 |
| 4,762,480 | A * | 8/1988 | Winkler et al. | 418/266 |
| 6,371,745 | B1 * | 4/2002 | Bassine | 418/268 |
| 2002/0192100 | A1 | 12/2002 | Wheeler | |

FOREIGN PATENT DOCUMENTS

| | | |
|---|---|---|
| GB | 327153 | 3/1930 |
| GB | 1578644 | 11/1980 |
| NO | 107036 | 1/2007 |
| SU | 1242629 | 7/1986 |
| WO | 03012259 | 2/2003 |

* cited by examiner

*Primary Examiner*—Theresa Trieu
(74) *Attorney, Agent, or Firm*—Christian D. Abel

(57) ABSTRACT

A motor driven by pressure medium supplied from an external pressure source. The motor comprises a motor casing with a working chamber, a stator pail which forms an axial supply pipe for supply of pressure medium to the working chamber, a rotor part which is rotatably mounted on the stator part and eccentrically arranged in the working chamber, the rotor part and the stator being provided with inlet ports for supply of pressure medium to the working chamber, a hinge part mounted on the rotor part and provided with a pivotably mounted piston which divides the working chamber into a pressure chamber and a discharge chamber, and a constantly open discharge opening which is arranged in the wall of the motor easing from the discharge chamber through which the medium is discharged.

4 Claims, 3 Drawing Sheets

MOTOR DRIVEN BY PRESSURE MEDIUM SUPPLIED FROM AN EXTERNAL PRESSURE SOURCE

FIELD OF THE INVENTION

The present invention relates to a motor driven by pressure medium supplied from an external pressure source, comprising a motor casing with a working chamber, which is divided into a pressure chamber and a discharge chamber by means of a piston, where a rotor part is rotatably mounted about a first axis, which is arranged eccentrically relative to the working chamber's main axis and which controls opening and closing of an inlet port of the pressure chamber, while the piston is pivot-mounted about a second axis parallel to the first axis.

BACKGROUND OF THE INVENTION

U.S. Pat. No. 3,871,337 and GB 1 578 644 disclose 4-stroke internal combustion engines. In both cases the engines are equipped with a rotor part which is rotatable in a circular cavity in the motor casing about an axis which is arranged concentrically to the motor casing's main axis.

In U.S. Pat. No. 3,871,337 four working chambers are illustrated, the extent of each being limited in a 90 degree area within the rotor part's radial dimension in the motor casing. The working chambers are subjected in turn to each of their four strokes in the internal combustion engine. In each working chamber there works a piston in the form of a flat plate part, each of which is hinged to the rotor part. The plate parts are each subjected to forcible swiveling movement forwards and backwards in a limited area in their related working chamber in the rotor part.

GB 1 578 644 illustrates a motor of a similar kind, provided with six working chambers.

The motor according to the invention involves an expansion motor, i.e. a simple single stroke motor, driven by pressure supplied by a pressure medium such as gas, air, steam or hydraulics. By means of a piston the rotor part is set in rotation, generating motive power from an outgoing drive shaft in extension of the rotor part. In a known per se manner the rotor part is rotatable about an axis that is eccentrically located in the motor casing, thus enabling the rotor part in a restricted area on the rotor part's periphery to form rotating sealing abutment against the motor casing's inner wall, while remaining areas of the rotor's periphery are uncovered against the remaining cavity that forms the actual working chamber. The piston divides the disposable working chamber into a pressure chamber and a discharge chamber by means of the said piston.

NO 107 036 illustrates a single stroke motor with a cylindrical cavity and a rotor part that is eccentrically mounted in a related cavity. The rotor part carries a piston-forming plate part, which by means of a pressure spring is pushed in the rotor's radial direction to sliding support abutment against the cavity's peripheral wall. As a result of the use of a radially movable, piston-forming plate part in the rotor part, the rotor part necessarily occupies a large portion of the motor casing's cavity, with the result that the volume of the working chamber is severely limited with correspondingly limited ability for axial movement for the piston-forming plate part.

WO 03/012259 discloses a single stroke motor with a non-cylindrical cavity in the motor casing. In the motor casing a cylindrical rotor part is rotatably mounted which forms the motor's piston and which is provided with rotational power from applied pressure medium. In addition, in the motor casing one end of a plate part is pivot-mounted, which is arranged to be pivoted with the opposite end inwards towards the rotor part in order to form a sealing abutment against the rotating rotor part, controlled by the pressure force in the pressure medium. The plate part is curved in the longitudinal direction, thus enabling it when pivoting backwards and forwards in the motor casing's cavity to form sliding sealing abutment against the rotor part. The plate part uncovers and covers a radially outer port opening for supply of pressure medium to the motor's pressure chamber, while the rotor part similarly covers and uncovers a radially inwardly located port opening for draining discharge medium from the discharge chamber. With its cylindrical peripheral surface, the piston-forming rotor part, which is cylindrical in shape, provides poor utilisation of the energy supplied to the motor. In addition, the solution requires a working chamber with a complicated shape, i.e. an approximate figure-of-eight shape. Moreover, the relatively large dimensions employed for the rotor part and for the plate part provide a relatively poor utilisation of the working chamber's volume.

The object of the present invention is to provide a simpler and more efficient solution than that derived from WO 03/012259, which represents the most obvious state of the art.

SUMMARY OF THE INVENTION

The motor according to the invention is characterised in that in a known per se manner the rotor part creates sealing-forming abutment against a local area of the working chamber's circular peripheral wall, that the piston is formed by the curved plate part, which at one end is pivot-mounted on the rotor part and at the other end is arranged with sealing-forming abutment against the working chamber's circular peripheral wall, and that the plate part can be pivoted forwards and backwards in the working chamber towards and away from the rotor part's peripheral surface, controlled by the pressure medium.

By employing according to the invention a cylindrical cavity in the motor instead of a figure-of-eight cavity, and by employing a piston formed from the forwardly and backwardly pivoted plate part instead of a piston formed from the actual rotor part, several advantageous effects are achieved.

For example, with a simply designed, relatively voluminous working chamber and with a favourable movement of the piston relative to the rotor part, it is possible to utilise the working chamber in a particularly efficient manner. Due amongst other things to the fact that the curved plate part has a concavely curved pressure side surface, an effective increase is achieved in the piston's radial length during simultaneous expansion of the pressure chamber, thereby achieving a high torque over a relatively large angle of rotation. Correspondingly, an effective reduction is achieved of the piston's pressure-balanced, convexly curved lateral surface during draining of discharge medium from the discharge chamber. In this connection a significant advantage is that the port opening for draining discharge medium from the motor casing's cavity is constantly open, thus enabling the draining to be carried out in a convenient manner in a pressure-balanced discharge chamber.

In a passive working condition, the piston's concavely curved pressure surface can be joined in a sealing-forming manner to a corresponding convexly curved portion on the rotor part and simultaneously with a convexly curved back surface be joined in a sealing-forming manner to the cavity's cylindrical inner wall in the narrow gap between the motor casing and the rotor part. This means that the rotor part with related piston part is easily adapted for efficient sealing relative to the cavity's inner wall particularly in the piston's said passive working position.

The motor according to the invention is further characterised in that a stator part forms an axial supply pipe for supply of pressure medium to the rotor part, and a port opening in the stator part interacts with a port opening in the rotor part for supply of pressure medium to the working chamber, and that in the motor casing's wall there is provided a constantly open discharge opening from the working chamber to discharge.

This solution permits an advantageous flow of pressure medium from the stator part radially inwards in the working chamber via the rotor part. At the same time an advantageous control is achieved of the rotor's inlet port by the rotor part's rotation relative to the stator part. The constantly open discharge from the working chamber similarly permits an advantageous flow of discharge medium radially outwards from the working chamber.

The efficiency of the motor according to the invention can easily be enhanced by a further simple increase in the motor's capacity.

A preferred embodiment in this regard is for the rotor part to be provided with two forwardly and backwardly pivoting piston-forming plate parts, which are mounted on the rotor part on diametrically opposite sides thereof.

A second preferred solution is for two or more separate cavities to be arranged in-line along the motor's centre line, each of which cavities forms a working chamber, the separate cavities' related port openings, which are arranged in the rotor part's storage sleeve, being located angularly displaced relative to one another.

Further features of the present invention will become evident from the following description with reference to the accompanying drawings, in which:

DETAILED DESCRIPTION OF PREFERRED EMBODIMENTS

Figure 1:
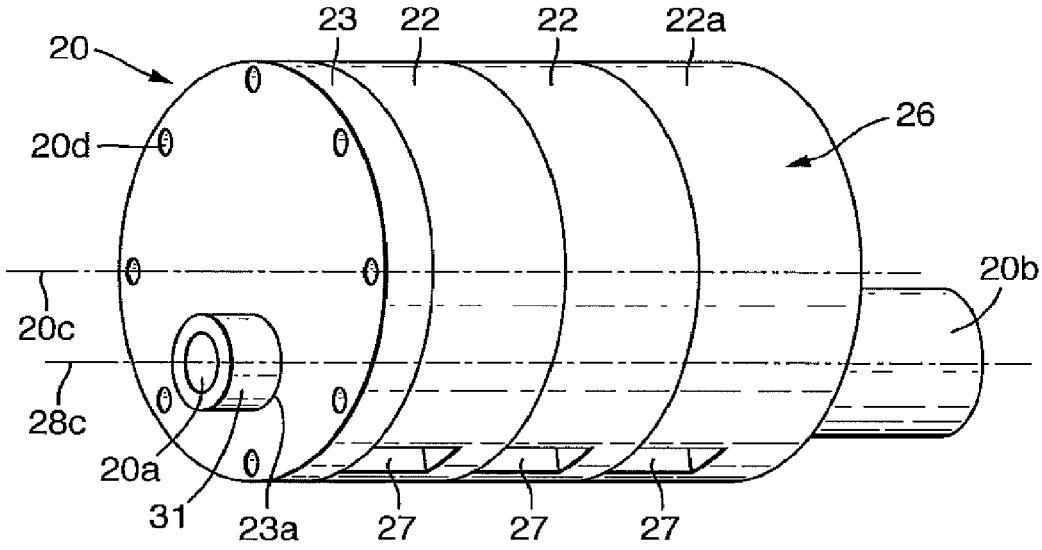
FIG. 1 is a perspective view of a motor according to the invention, provided with three separate working chamber-forming cavities.

In FIG. 1 a motor 20 according to the invention is illustrated with a main axis 20*c* and an intake 20*a* for pressure medium at one end and with an outgoing drive shaft 20*b* at its opposite end. The motor 20 is in the form of a single stroke motor, which is driven by means of a pressure medium delivered from an external pressure medium source. The drive pressure may, for example, be transmitted to the rotor part by means of gas, air, steam or hydraulics.

In FIG. 1 a motor 20 according to the invention is illustrated with an intake 20*a* for pressure medium at one end and with an outgoing drive shaft 20*b* at its opposite end. The motor 20 is in the form of a single stroke motor, which is driven by means of a pressure medium delivered from an external pressure medium source. The drive pressure may, for example, be transmitted to the rotor part by means of gas, air, steam or hydraulics.

Figure 3:
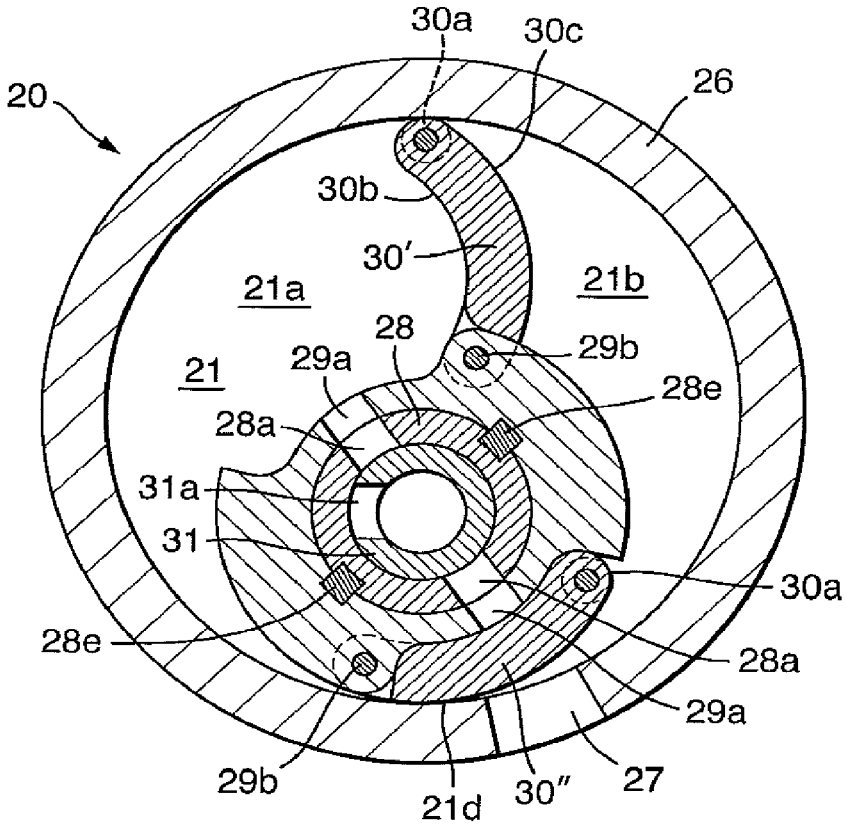
FIG. 3 is a general view of a cross section of a working chamber in the motor.

As illustrated in FIG. 3 the motor is composed of four main components: a motor casing 26, a stator part 31, a rotor part 28 with related hinge part 29, plus two pistons 30.

According to an embodiment as illustrated in FIG. 1 three motor sections are employed in-line in the motor's axial direction, but in practice a single motor section may be employed as required or two or more such motor sections similarly mounted in-line. In this case the motor 20 is equipped with three cylindrical cavities, each with its working chamber 21 arranged in-line in a common, cylindrical motor casing 26.

In general the motor casing 26 is composed of a front chamber 22*a* and two intermediate chambers 22, together with a back plate 23, which are interconnected by means of through-going bolts (not shown) in the holes 20*d*.

Figure 2:
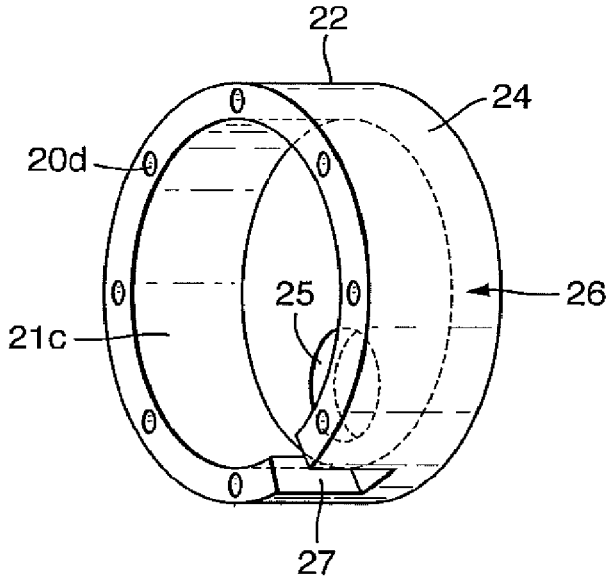
FIG. 2 is a perspective view of an intermediate chamber.

In FIG. 2 an intermediate chamber 22 is illustrated that forms a cylindrical sleeve and defines a cylindrical cavity in the radial and axial directions. The front chamber 22*a* differs from the intermediate chambers 22 in that it has bearings (not shown) for mounting a rotor 28.

The front chambers 22*a* and each of the intermediate chambers 22 are each provided on the periphery by a cut-out that forms a related discharge port 27 from the motor casing 26. The discharge port 27 is constantly open for draining discharge medium from a related discharge chamber 21*b* in the motor casing 26.

The rotor's 28 torque is arranged to be optimal for a substantial angle of rotation, for example 120° for each of the pistons 30 per rotation and that the rotor's 28 total torque in the six pressure chambers 21*a* is similarly optimal over a 360° angle of rotation. Optimal utilisation is hereby achieved of pressure medium supplied in the said 360° angle of rotation while at the same time there is minimal vibration in the motor when it is running. The motor's parts and the motor's construction are so designed that all parts can easily be produced in automated machines. It is also very easy to assemble and disassemble the motor and in most cases this can be done without the use of special tools. There is no need for a starting motor and flywheel. The motor will run very well and smoothly with three or more pistons.

In the intermediate chambers 22, as illustrated in FIG. 2, a bore 25 is provided to receive the rotor part's 28 central portion 28*b*.

In the back plate 23, as illustrated in FIG. 1, there is a bore 23*a* for receiving one end of a stator part 31 that is equipped with the motor's pressure medium intake 20*a*. The stator part 31 is tubular, forming an internal supply pipe for supply of pressure medium from the intake 20*a* to the rotor part 28.

Illustrated in FIG. 3 are the motor casing 26, the stator part 31, the rotor part 28 with the hinge part 29. The rotor part 28 and the hinge part 29 are interconnected by keys. The keys are received in keyways 28*d* on the rotor part and in keyways 29*d* on the hinge part 29. The pistons 30 which are pivot-mounted to the hinge part 29 at axis 30*d* are attached to rotor part 28 by keys that match related keyways 28*d* on rotor part 28. Hinge part 29 with pistons 30', 30" hinged thereon form sealing surfaces against the motor casing's 26 inner wall at point 21*d*. The hinge part 29 also has a cut-out for receiving the pistons 30', 30" which alternately form a sealing surface against the motor casing's 26 inner wall 21*d* when the pistons 30', 30" pass in fully inwardly pivoted condition.

The rotor part 28 and related stator part 31 run in the axial direction through each of the chambers 21 in the motor casing 26. The rotor part's 28 axis of rotation 28*c* and the stator part's

31 concentric central axis 28*c* are arranged eccentrically relative to the motor casing's 26 main axis 20*c*.

Figure 5:
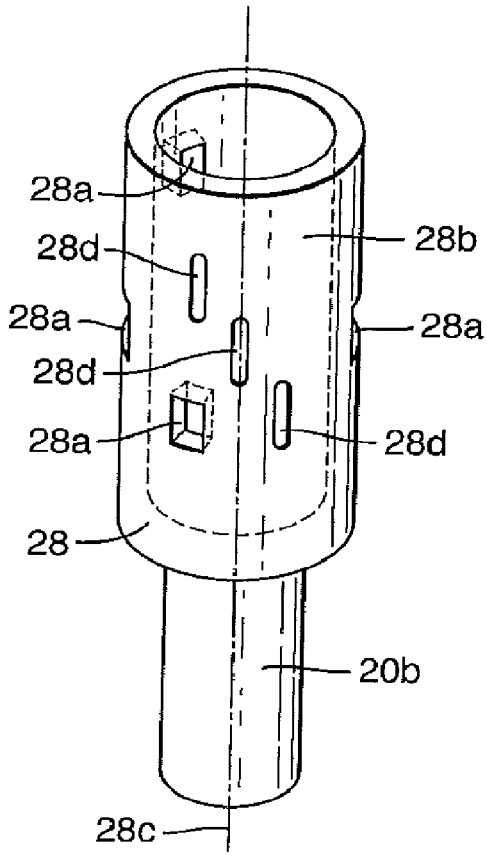
FIG. 5 is a perspective view of a rotor part with related, outgoing drive shaft.

In FIG. 5 the rotor part 28 is illustrated in the form of a cylindrical sleeve with shaft 20*b*. In the rotor part's 28 sleeve wall six through-going port openings 28*a* are provided which communicate with the port openings 29*a* in the hinge part 29 and discharge directly into related pressure chamber 21*a*.

Figure 4:
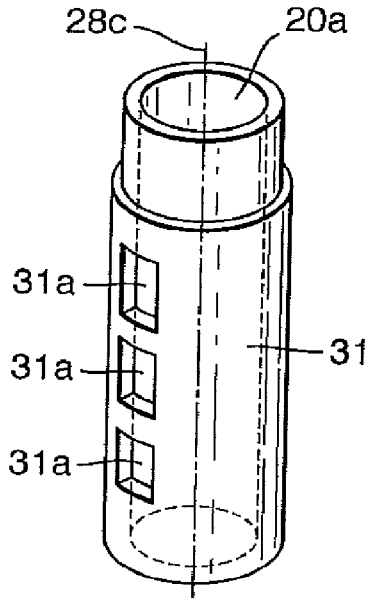
FIG. 4 is a perspective view of a stator part, which forms a supply pipe for pressure medium via the rotor part to the working chamber.

In FIG. 4 the stator part 31 is illustrated with three port openings 31*a* arranged axially in-line in the stator part's longitudinal direction. In specific angular positions each of the rotor part's 28 port openings 28*a* communicates in succession with its related stationary port opening 31*a* in the stator part 31.

Figure 6:
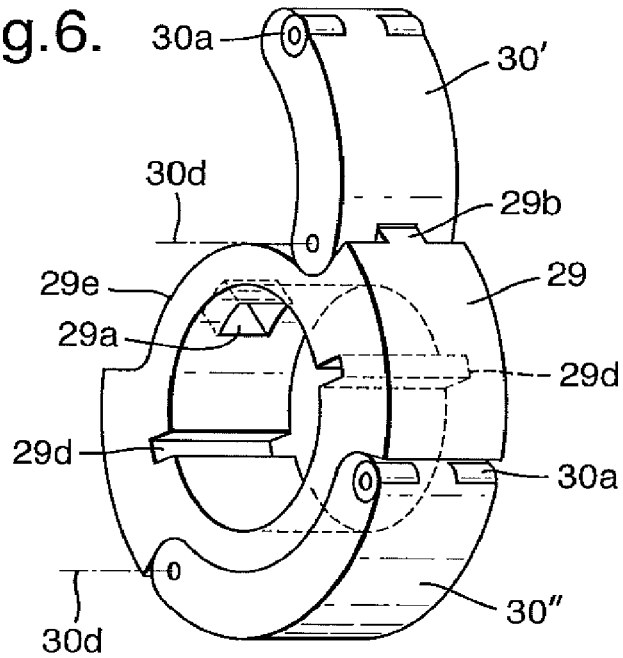
FIG. 6 is a perspective view of the rotor's hinge part for the rotor's pistons.

The piston part 30, which is illustrated in greater detail in FIG. 6, is equipped at its outer end with two supporting rollers 30*a*, which provide rolling support and sealing against the motor casing's 26 inner wall 21*c*. The pivoting of the piston part 30 backwards and forwards relative to the rotor part 28 takes place about an axially extending axis 30*d*, on the hinge part 29, which runs parallel to the rotor part's 28 axis of rotation 28*c*. The piston-forming plate part 30 is provided with a concavely curved pressure surface 30*b* facing the pressure chamber 21*a* or the hinge part 29 and equipped with a corresponding convexly curved back surface 30*c* facing the discharge chamber 21*b*.

When the rotor part's 28 piston 30 has performed a pivoting movement forwards and backwards relative to the rotor part 28, the piston 30 in an inactivated state is received in the cut-out 29*c*. In this position the piston's 30 convexly curved back surface 30*c* provides sealing-forming abutment against the motor casing's 26 cylindrical inner wall 21*d*.

FIG. 3 illustrates the hinge part 29 with two piston parts 30', 30". The piston parts 30', 30" are pivot-mounted on diametrically opposite sides of the hinge part 29. This means that the pistons 30', 30" can work in two opposite working phases during the rotor part's 28 angle of rotation (360°), each simultaneously providing an effective torque to the rotor part 28 in the two opposite working phases.

FIG. 3 also illustrates the piston part 30' with optimal surface area across the rotor part's 28 radial plane, while the piston 30" has minimal surface area across the rotor part's 28 radial plane. In this position the plate part 30" is received in the cut-out 29*c* which permits passage of the motor casing's 26 sealing point 21*d*.

The invention claimed is:

1. A motor driven by pressure medium supplied from an external pressure source, the motor comprising a motor easing with a working chamber having a cylindrical inner wall and a main axis, a stator part which forms an axial supply pipe for supply of pressure medium to the working chamber through a port opening in the stator part, a rotor part which is rotatably mounted on the stator part, the rotor part's axis of rotation being arranged eccentrically relative to the working chamber's main axis, the rotor part being provided with an inlet port such that the port opening in the stator part interacts with the inlet port in the rotor part for supply of pressure medium to a pressure chamber in the working chamber, a hinge part which is mounted to the rotor part and which provides a sealing-forming abutment against the working chamber's inner wall, the hinge part being provided with a port opening which communicates with the inlet port in the rotor part, the hinge part being further provided with a piston which is formed by a curved plate part, the piston being pivotably mounted on the hinge part in one end, and arranged with a sealing-forming abutment against the working chamber's inner wall at the other end, the piston dividing the working chamber into the pressure chamber and a discharge chamber when the motor is operating, a constantly open discharge opening to discharge, the discharge opening being arranged in the wall of the motor casing from the working chamber's discharge chamber.

2. A motor according to claim 1, wherein the hinge part is provided with two pistons, which are pivotably mounted on the hinge part and on diametrically opposite sides of the hinge part.

3. A motor according to claim 1, wherein the piston is formed with a concavely curved pressure surface which provides sealing-forming abutment against the rotor part's peripheral surface and is equipped with a convexly curved back surface in order to form sealing abutment against the motor casing's inner wall.

4. A motor according to claim 1, wherein two or more motor casings are arranged in-line along the motor's main axis, each motor casing having a separate working chamber, the inlet openings in the rotor part to the working chambers in the motor casings being located angularly displaced relative to one another.

* * * * *